US011421688B2

(12) United States Patent
Sa et al.

(10) Patent No.: US 11,421,688 B2
(45) Date of Patent: Aug. 23, 2022

(54) VANE COMPRESSOR WITH ELASTIC MEMBER PROTRUDING INTO THE CYLINDER

(71) Applicant: LG ELECTRONICS INC., Seoul (KR)

(72) Inventors: Bumdong Sa, Seoul (KR); Joonhong Park, Seoul (KR); Seseok Seol, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 66 days.

(21) Appl. No.: 17/113,230

(22) Filed: Dec. 7, 2020

(65) Prior Publication Data

US 2021/0180597 A1 Jun. 17, 2021

(30) Foreign Application Priority Data

Dec. 11, 2019 (KR) ..... 10-2019-0164791

(51) Int. Cl.
*F04C 18/344* (2006.01)
*F01C 21/08* (2006.01)
(Continued)

(52) U.S. Cl.
CPC ..... *F04C 18/344* (2013.01); *F01C 21/0845* (2013.01); *F01C 21/106* (2013.01);
(Continued)

(58) Field of Classification Search
CPC .... F04C 18/344; F04C 29/12; F04C 2240/10; F04C 2240/50; F04C 2250/10; F01C 21/0845; F01C 21/106; F05C 2251/14
See application file for complete search history.

(56) References Cited

U.S. PATENT DOCUMENTS 8,821,143 B2 * 9/2014 Takahashi ..... F01C 21/106 418/270

FOREIGN PATENT DOCUMENTS

JP 4119423 7/2008
JP 2012-167578 9/2012
(Continued)

OTHER PUBLICATIONS

Korean Notice of Allowance dated Mar. 30, 2021.

*Primary Examiner* — Mary Davis
(74) *Attorney, Agent, or Firm* — KED & Associates LLP

(57) ABSTRACT

A vane-type compressor is provided. The vane-type compressor may include a cylindrical cylinder having opposite open ends along an axial direction, an inner circumferential surface of the cylinder being eccentric from an outer circumferential surface of the cylinder, a main bearing and a sub bearing, respectively, positioned at the open ends of the cylinder, a rotor coupled to a shaft supported by the main bearing and the sub bearing and installed eccentric from the inner circumferential surface of the cylinder, and a plurality of vanes coupled to the rotor to rotate along with the rotor, the plurality of vanes dividing the inner circumferential surface of the cylinder into a plurality of spaces including a suction chamber and a compression chamber when the rotor rotates. An elastic member may be installed at a point at which a minimum gap is maintained between the inner circumferential surface of the cylinder and the rotor so that a portion of the elastic member protrudes inward of the inner circumferential surface of the cylinder. An end of a discharge dimple formed in the inner circumferential surface of the cylinder extends up to the point.

21 Claims, 9 Drawing Sheets

(51) Int. Cl.
*F01C 21/10* (2006.01)
*F04C 29/12* (2006.01)

(52) U.S. Cl.
CPC ..... *F04C 29/12* (2013.01); *F04C 2240/10* (2013.01); *F04C 2240/50* (2013.01); *F04C 2250/10* (2013.01); *F05C 2251/14* (2013.01)

(56) References Cited

FOREIGN PATENT DOCUMENTS

| | | | |
|---|---|---|---|
| KR | 930008393 | B1 * | 8/1993 |
| KR | 10-2018-0080885 | | 7/2018 |
| KR | 10-2019-0106275 | | 9/2019 |
| KR | 10-2019-0106329 | | 9/2019 |

* cited by examiner

VANE COMPRESSOR WITH ELASTIC MEMBER PROTRUDING INTO THE CYLINDER

CROSS-REFERENCE TO RELATED APPLICATION(S)

This application claims priority to and the benefit of Korean Patent Application No. 10-2019-0164791 filed in the Korean Intellectual Property Office on Dec. 11, 2019.

BACKGROUND

1. Field

A vane-type compressor is disclosed herein.

2. Background

A compressor refers to a device that receives power from a power generating device, such as a motor or a turbine, and compresses a working fluid, such as air or coolant. Such compressors may be divided into reciprocating compressors, rotary compressors, and scroll compressors depending on how the working fluid is compressed.

Reciprocating compressors have a compression space, into and from which the working gas is suctioned and discharged, between the piston and the cylinder and compress the working fluid while the piston linearly reciprocates in the cylinder. Rotary compressors have a compression space, in which the working gas is suctioned and discharged, between the eccentrically rotating roller and the cylinder, and compress the working fluid while the roller eccentrically rotates along an inner wall of the cylinder. Scroll compressors have such a compression space between the orbiting scroll and the fixed scroll, and compress the coolant as the orbiting scroll rotates along the fixed scroll.

Among such compressors, the rotary compressors have a rotor and a vane in contact with each other, with the compression space of the cylinder divided into a suction chamber and a discharge chamber with respect to the vane. As the rotor orbits, the vane linearly moves so that a volume of the suction chamber and the discharge chamber is varied to thereby suction, compress, and discharge the working fluid.

There are also known vane-type compressors in which, unlike the rotary compressor, the vane is inserted to the rotor and, as the same is rotated along with the rotor, the vane is drawn out by centrifugal force and back pressure to form a compression chamber. In such a vane-type compressor, as typically multiple vanes rotate together with the rotor, a sealing surface of the vane slides in contact with an inner circumferential surface of the cylinder. Thus, the vane-type compressor causes more friction loss compared with the general rotary compressor.

The vane-type compressor typically has a circular inner circumferential surface of the cylinder. Recently, there have been introduced vane-type compressors that have a so-called "hybrid cylinder" that has an oval inner circumferential surface to reduce friction loss and increase compression efficiency.

Japanese Patent Application Publication No. 2012-167578 (hereinafter, the "related art document"), which is hereby incorporated by reference, discloses an example of a vane-type compressor. The vane-type compressor disclosed in the related art document is briefly described below with reference to FIGS. 1 to 5.

FIG. 1 is a cross-sectional view illustrating a related art vane-type compressor. FIG. 2 is an exploded perspective view of a compression element of the vane-type compressor of FIG. 1. FIG. 3 is a perspective view illustrating a vane aligner and a second vane of the vane-type compressor of FIG. 1. FIG. 4 is a plan view of a compression element (rotation angle 90°) of the vane-type compressor of FIG. 1. FIG. 5 is a plan view of a compression element, showing a compression operation of the vane-type compressor of FIG. 1.

The vane-type compressor 100 of FIG. 1 may be applied to refrigerators, freezers, or air conditioners, for example. For example, an air conditioner may include a vane-type compressor 100 to compress coolant, a condenser, a decompressor, and an evaporator.

The vane-type compressor 100 is formed to have a compression element 101 or unit and an electromotive element or unit (drive motor) 102 that drive the compression element 101 in a sealed container 103. The compression element 101 is positioned on or at a bottom of the sealed container 103, and a cooling oil 25 at a lower part of the sealed container 103 is supplied to the compression element 101 by a feeder to lubricate each sliding part of the compression element 101.

The electromotive element 102 that drives the compression element 101 may be configured as, for example, a brushless DC motor and is controlled so that its rpm is varied by a drive circuit. The electromotive element 102 may include a stator 21 fixed to an inner circumferential surface of the sealed container 103 and a rotor 22 formed of a permanent magnet and installed inside of the stator 21. Power is supplied from a power supply terminal 23 fixed to the sealed container 103 to the stator 21.

The compression element 101 suctions a low-pressure coolant from suction pipe 26 to a compression chamber and compresses the coolant. The compressed coolant is discharged to the sealed container 103 and passes through the electromotive element 102 and is then discharged from discharge pipe 24 fixed to an upper part or portion of the sealed container 103 outside (high-pressure side of a cooling cycle). The vane-type compressor 100 may be a high-pressure type, in which the inside of the sealed container 103 is at high pressure, or a low-pressure type, in which the inside of the sealed container 103 is at low pressure.

The compression element 101 includes cylinder 1, main bearing 2, sub bearing 3, rotor shaft 4, vane aligners 5 and 7, vane aligners 6 and 7, first vane 9, second vane 10, and bushing 11 and 12, which are discussed hereinafter.

The cylinder 1 is substantially cylindrical in shape, and both ends of which, in an axial direction, are open. A suction dimple 1*b* is formed in a cylinder inner circumferential surface 1*a* over an entire range of the axial direction to be larger to an outer circumferential surface than the cylinder inner circumferential surface 1*a*, and a suction port 1*c* is formed in the cylinder inner circumferential surface 1*a* or the suction dimple 1*b*.

The main bearing 2 has a substantially "T"-shaped cross section, and a portion thereof, which abuts the cylinder 1, has a substantially circulate plate shape. One opening (an upper one in FIG. 2) of the cylinder 1 is closed. A ring groove-shaped vane aligner holder 2*a*, which is concentric to the cylinder inner circumferential surface 1*a* is formed on an end surface of the main bearing 2, on a side of the cylinder 1, and vane aligners 5 and 7 are coupled to the vane aligner holder 2*a*. A center portion of the main bearing 2 has a cylindrical shape, and a bearing hole 2*b* is formed therethrough. A discharge port 2*c* is formed substantially in a middle of the main bearing 2.

The sub bearing 3 has a substantially "T"-shaped cross section, and a portion thereof, which abuts the cylinder 1, has a substantially circulate plate shape, and the other opening (the lower one in FIG. 2) of the cylinder 1 is closed.

A ring groove-shaped vane aligner holder 3*a* which is concentric to the cylinder inner circumferential surface 1*a* is formed on an end surface of the sub bearing 3, on a side of the cylinder 1, and vane aligners 6 and 8 are coupled to the vane aligner holder 3*a*. A middle portion of the sub bearing 3 is cylindrical in shape, and a bearing hole 3*b* is formed therethrough.

The rotor shaft 4 has a structure in which a rotor part or portion 4*a*, which rotates on a central axis eccentric with respect to a central axis of the cylinder 1, and upper and lower rotational shaft parts or portions 4*b* and 4*c* of the rotor part 4*a* are integrally formed with each other. The rotational shaft parts 4*b* and 4*c* are engaged with the bearing hole 2*b* of the main bearing 2 and the bearing hole 3*b* of the sub bearing 3, respectively.

The rotor part 4*a* includes bushing installation parts or portions 4*d* and 4*e* and vane installation parts 4*f* and 4*g*. The bushing installation part 4*d* and the vane installation part 4*f* communicate with each other, and the bushing installation part 4*e* and the vane installation part 4*g* communicate with each other. The bushing installation part 4*d* and the bushing installation part 4*e*, and the vane installation part 4*f* and the vane installation part 4*g*, are positioned substantially symmetrical with each other.

The vane aligners 5 and 7 are partial ring-shaped components, and respectively, have vane holders 5*a* and 7*a*, which are rectangular protrusions, on their respective first end surfaces (the bottom surfaces in FIG. 2). The vane holders 5*a* and 7*a* are formed in an arc normal direction of the partial rings. An arc shape of the vane tips 9*a* and 10*a* may have substantially a same radius as the cylinder inner circumferential surface 1*a* of the cylinder 1.

The vane aligners 6 and 8 are partial ring-shaped components, and respectively, have vane holders 6*a* and 8*a*, which are rectangular protrusions, on their respective first end surfaces (the top surfaces in FIG. 2). The vane holders 6*a* and 8*a* are formed in the arc normal direction of the partial rings. An arc shape of the vane tips 9*a* and 10*a* may have substantially the same radius as the cylinder inner circumferential surface 1*a* of the cylinder 1.

The first vane 9 is shaped as a substantially rectangular plate, and vane tip 9*a* positioned on a side of the cylinder inner circumferential surface 1*a* of the cylinder 1 is shaped as an arc. The arc shape has substantially the same radius as the cylinder inner circumferential surface 1*a* of the cylinder 1. Back surface slits 9*b*, to which the vane holder 5*a* of the vane aligner 5 and the vane holder 6*a* of the vane aligner 6 are fitted, are formed in a back surface of the first vane 9, which is opposite the cylinder inner circumferential surface 1*a*.

The second vane 10 is shaped as a substantially rectangular plate, and vane tip 10*a* positioned on a side of the cylinder inner circumferential surface 1*a* of the cylinder 1 is shaped as an arc. The arc shape has substantially the same radius as the cylinder inner circumferential surface 1*a* of the cylinder 1. Back surface slits 10*b*, to which the vane holder 7*a* of the vane aligner 7 and the vane holder 8*a* of the vane aligner 8 are fitted, are formed in a back surface of the second vane 10, which is opposite the cylinder inner circumferential surface 1*a*.

Each of the bushings 11 and 12 is formed in a pair on a corresponding half circular circumference. The bushings 11 and 12 are fitted into the bushing installation parts 4*d* and 4*e*, and the first vane 9 and the second vane 10 are held in the bushings 11 and 12 to be rotatable on the rotor part 4*a* while simultaneously moving substantially in the direction of the normal.

FIG. 2 illustrates a state before the first vane 9 and the second vane 10, respectively, are integrated with the vane aligners 5 and 6 and the vane aligners 7 and 8. In practice, the vane holders 5*a* and 6*a* of the vane aligners 5 and 6 are fitted into the back slits 9*b* of the first vane 9, and the vane holders 7*a* and 8*a* of the vane aligners 7 and 8 are fitted into the back slits 10*b* of the second vane 10, so that the first vane 9 is integrated with the vane aligners 5 and 6, and the second vane 10 is integrated with the vane aligners 7 and 8.

FIG. 3 illustrates a state in which the second vane 10 is integrated with the vane aligner 8. As the first vane 9 is integrated with the vane aligners 5 and 6, and the second vane 10 is integrated with the vane aligners 7 and 8, the arc normal of the tips of the first vane 9 and the second vane 10 is restricted so that its direction remains consistent with the normal of the cylinder inner circumferential surface 1*a*, and movement of the first vane 9 and the second vane 10 along a direction of normal of the rotor is limited.

The first vane 9, vane aligner 5, and vane aligner 6, which have been integrated together, are rotated around the central axis of the cylinder inner circumferential surface 1*a*, and a distance between the central axis of the cylinder inner circumferential surface 1*a* and the vane tip 9*a* remains smaller than (or substantially identical to) a radius of the cylinder inner circumferential surface 1*a*. The same is also true for the second vane 10, vane aligner 7, and vane aligner 8.

Operations are described hereinafter. When the rotational shaft part 4*b* of the rotor shaft 4 receives a rotational force from a drive, for example, the electromotive element 102, or in a case of engine driving, an engine, the rotor part 4*a* rotates in the cylinder 1. As the rotor part 4*a* rotates, the bushing installation parts 4*d* and 4*e* disposed around the rotor part 4*a* move on a circular circumference around the central axis of the rotor shaft 4. The bushing pairs 11 and 12 held in the bushing installation parts 4*d* and 4*e* and the first vane 9 and second vane 10, which are held to be rotatable between the bushing pairs 11 and 12 are also rotated along with the rotor part 4*a*.

The direction of the first vane 9 is limited to the direction of the normal to the cylinder 1 by the partial ring-shaped vane aligners 5 and 6 rotatably coupled to the vane aligner holder 2*a* and the vane aligner holder 3*a* formed on the end surfaces, on the side of the cylinder, of the main bearing 2 and the sub bearing 3, and movement of the first vane 9 along the direction of the normal to the rotor part 4*a* is limited. The direction of the second vane 10 is limited to the direction of the normal to the cylinder 1 by the partial ring-shaped vane aligners 7 and 8 rotatably coupled to the vane aligner holder 2*a* and the vane aligner holder 3*a* formed on the end surfaces, on the side of the cylinder, of the main bearing 2 and the sub bearing 3, and movement of the second vane 10 along the direction of the normal to the rotor port 4*a* is limited. Further, the first vane 9 may be pressurized towards the cylinder inner circumferential surface 1*a* of the cylinder 1 by centrifugal force, a spring (not shown), or a difference in pressure (in the case of a configuration to guide a high-pressure or medium-pressure coolant to the space behind the first vane 9) between the vane tip 9*a* and the back slits 9*b*.

The first vane 9 is integrated with the vane aligner 5 and the vane aligner 6. The first vane 9, vane aligner 5, and vane aligner 6, which have been integrated together, are rotated around the central axis of the cylinder inner circumferential surface 1*a*, and the distance between the central axis of the cylinder inner circumferential surface 1*a* and the vane tip 9*a* remains smaller than (or substantially identical to) the radius of the cylinder inner circumferential surface 1*a*. Thus, the vane tip 9*a* does not contact the cylinder inner circumferential surface 1*a* of the cylinder 1, and the vane aligners 5 and 6 rotate while sliding on the vane aligner holder 2*a* and the vane aligner holder 3*a*. As the arc of the vane tip 9*a* of the first vane 9 and the cylinder inner circumferential surface 1*a* of the cylinder 1 have substantially the same radius, and their normal lines are substantially identical to each other, they rotate, with a fine gap formed therebetween.

Although not described in detail, the second vane 10 may be considered as installed and operated in the same manner as the first vane 9.

A compression principle of the vane-type compressor 100 is substantially the same as that of related art vane-type compressors.

FIG. 4 is a plan view (rotational angle of 90°) of the compression element 101 of the vane-type compressor 100. Referring to FIG. 4, the rotor part 4*a* of the rotor shaft 4 and the cylinder inner circumferential surface 1*a* of the cylinder 1 are closest to each other at one point (nearest point of FIG. 4). The "nearest point" may also be referred to as a "proximate part."

As the first vane 9 and the second vane 10 each are positioned near the cylinder inner circumferential surface 1*a* of the cylinder 1 at one point, three spaces, for example, the suction chamber 13, intermediate chamber 14, and compression chamber 15, are formed in the cylinder 1. The suction chamber 13 includes open suction port 1*c* that communicates with the lower pressure part of the cooling cycle, and the compression chamber 15 has a discharge port 2*c* formed in the main bearing 2 or the sub bearing 3. The intermediate chamber 14 is sealed off without communicating with the suction port 1*c* or the discharge port 2*c*.

FIG. 5 is a plan view illustrating the compression element 101 and showing a compression operation of the vane-type compressor 100. Referring to FIG. 5, an example is shown in which a volume of the suction chamber 13, the intermediate chamber 14, and the compression chamber 15 is varied as the rotor shaft 4 rotates.

When the vane tip 9*a* of the first vane 9 approaches the nearest point where the rotor part 4*a* of the rotor shaft 4 is positioned closest to the cylinder inner circumferential surface 1*a* of the cylinder 1, it is defined as "angle 0°." A position where the rotor shaft 4 has turned 45° clockwise from the angle of 0° is defined as an "angle 45°," a position where the rotor shaft 4 has turned 45° clockwise from the "angle 45° " is defined as an "angle 90°," and the position where the rotor shaft 4 has turned 45° clockwise from the "angle 90° " is defined as an "angle 135°."

FIG. 5 illustrates positions of the first vane 9 and the second vane 10 at the "angle 0°," the "angle 45°," and the "angle 135° " and states of the suction chamber 13, intermediate chamber 14, and compression chamber 15 in those positions. An arrow indicating the rotational angle (clockwise direction) of the rotor shaft 4 is shown in the view of FIG. 5 for the "angle 0°," but not in the other views of FIG. 5, for the "angle 45°," "angle 90°," and "angle 135°." The post-180° states are not shown because at the "angle 180°," the positions at the "angle 0°," of the first vane 9 and the second vane 10 are opposite to each other.

The suction dimple 1*b* is formed in the cylinder inner circumferential surface 1*a*, which is larger in the outer circumferential direction than the cylinder inner circumferential surface 1*a* over the entire axial direction, in at least a portion of a range from the nearest point to point A (where a geometrical compression starts) where the vane tip 9*a* of the first vane 9 at the "angle 90°" is positioned adjacent to the cylinder inner circumferential surface 1*a* of the cylinder 1, and the suction port 1*c* is formed in the suction dimple 1*b*.

The discharge port 2*c* is positioned a predetermined distance to the left (for example, nearly 30°) from the nearest point, near the nearest point where the rotor part 4*a* of the rotor shaft 4 is positioned closest to the cylinder inner circumferential surface 1*a* of the cylinder 1. At the "angle 0°" of FIG. 5, the right space divided by the nearest point and the second vane 10 is the suction chamber 13 that communicates with the suction port 1*c*, and a gas (coolant) is suctioned into the suction chamber 13. The left space divided by the nearest point and the second vane 10 is the compression chamber 15 that communicates with the discharge port 2*c*.

At the "angle 45°" of FIG. 5, as the volume of the suction chamber 13 is larger than at the "angle 0°," the suction of gas continues. The volume of the compression chamber 15 which is the space divided by the second vane 10 and the nearest point reduces as compared with that at the "angle 0°," so that coolant may be gradually compressed, exhibiting an increased pressure.

At the "angle 90°" in FIG. 5, as the vane tip 9*a* of the first vane 9 overlaps point A over the cylinder inner circumferential surface 1*a* of the cylinder 1, the space which used to be the suction chamber 13 at the "angle 45°" does not communicate with the suction port 1*c* and becomes the intermediate chamber 14. At this time, the volume of the intermediate chamber 14 (the state in which it does not communicate with the suction chamber 1*c*) becomes substantially maximum. The volume of the compression chamber 15 is further reduced than that at the "angle 45°" so that the pressure of the coolant increases. In this state, the suction chamber 13, as an independent space communicating with the suction port 1*c*, is formed.

At the "angle 135°" of FIG. 5, the volume of the intermediate chamber 14 is smaller than at the "angle 90°," and thus, the pressure of the coolant increases. The volume of the compression chamber 15 is further reduced than that at the "angle 90°" so that the pressure of the coolant increases. The volume of the suction chamber 13 is larger than that at the "angle 90°" and suction continues.

Thereafter, the second vane 10 approaches the discharge port 2*c*. However, if the pressure of the compression chamber 15 becomes higher than the high pressure of the cooling cycle, the coolant in the compression chamber 15 is discharged through the discharge port 2*c* to the inside of the sealed container 103.

When the second vane 10 passes through the discharge port 2*c*, some high-pressure coolant remains in the compression chamber 15. At the "angle 180°" (which is the state where the positions of the first vane 9 and the second vane 10 at the "angle 0°" have replaced each other), when the compression chamber 15 disappears, the high-pressure coolant turns into a lower-pressure coolant in the suction chamber 13. Then, the compression operation repeats.

The thusly structured vane-type compressor has no friction between the cylinder and the vanes, advantageously exhibiting reduced noise and vibration. However, as the vane-type compressor needs to have vane aligners, vane aligner holders, and bushings to allow the vanes to be oriented to the center of the cylinder, the number of components necessary to do so increases. Thus, it is not easy to assemble the components due to accumulated tolerances of the components, and assembly and labor costs may increase.

Further, to reduce overcompression loss occurring when the gas (coolant) has been completely discharged, the discharge dimple needs to be processed up to the point where the cylinder and the rotor part are positioned closer, in which case the discharged high pressure gas (coolant) may leak into the suction chamber. Thus, as shown in the left view of FIG. 9, the discharge dimple 1*d* may not be processed up to the point (nearest point) where a minimum gap remains between the cylinder inner circumferential surface and the rotor part, but only to a point where it is spaced apart from the point by a predetermined distance D (D=4 mm to 5 mm).

BRIEF DESCRIPTION OF THE DRAWINGS

Embodiments will be described in detail with reference to the following drawings in which like reference numerals refer to like elements, and wherein.

DETAILED DESCRIPTION

Figure 1:
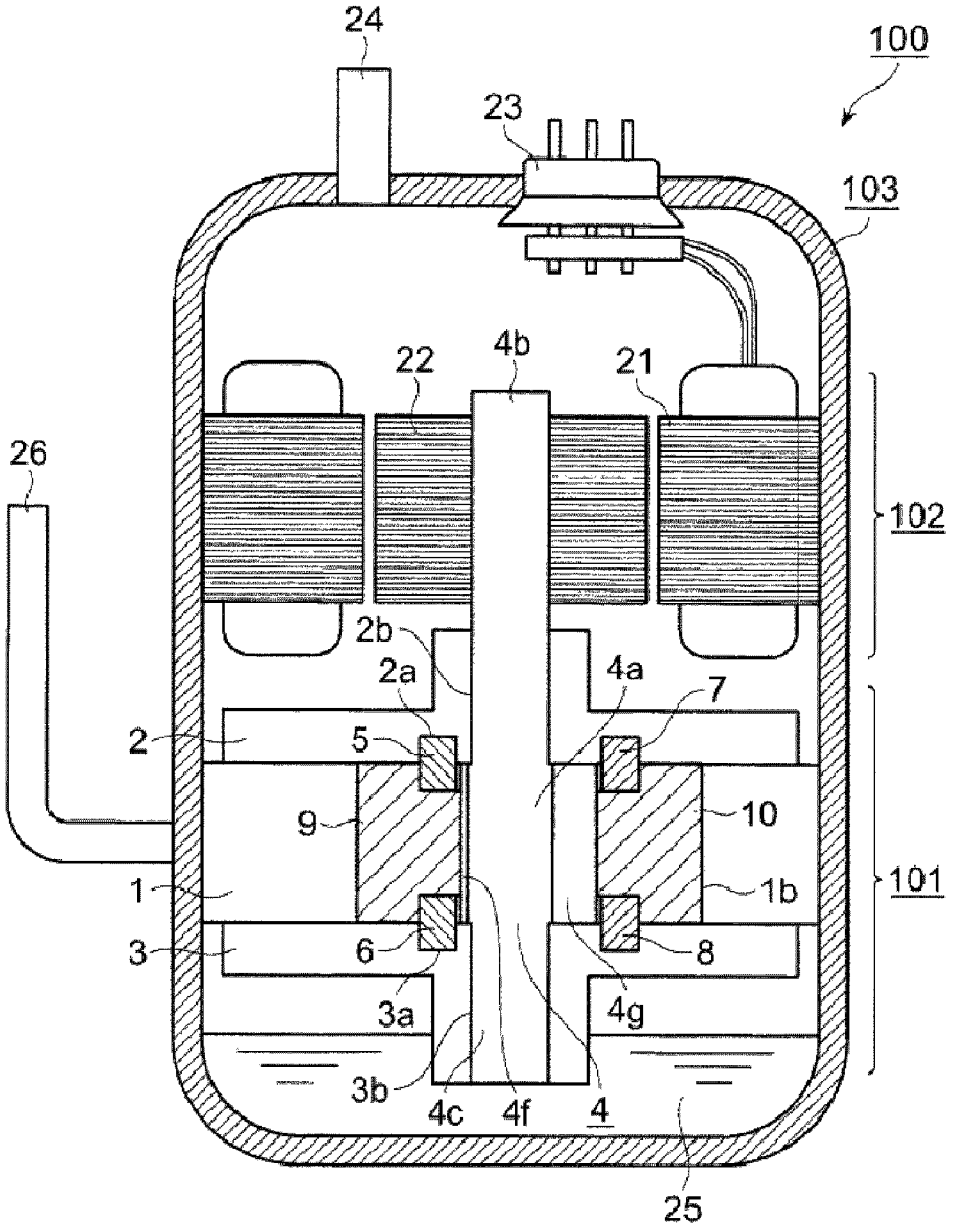
FIG. 1 RELATED ART
FIG. 1 is a cross-sectional view illustrating a related art vane-type compressor.
Figure 2:
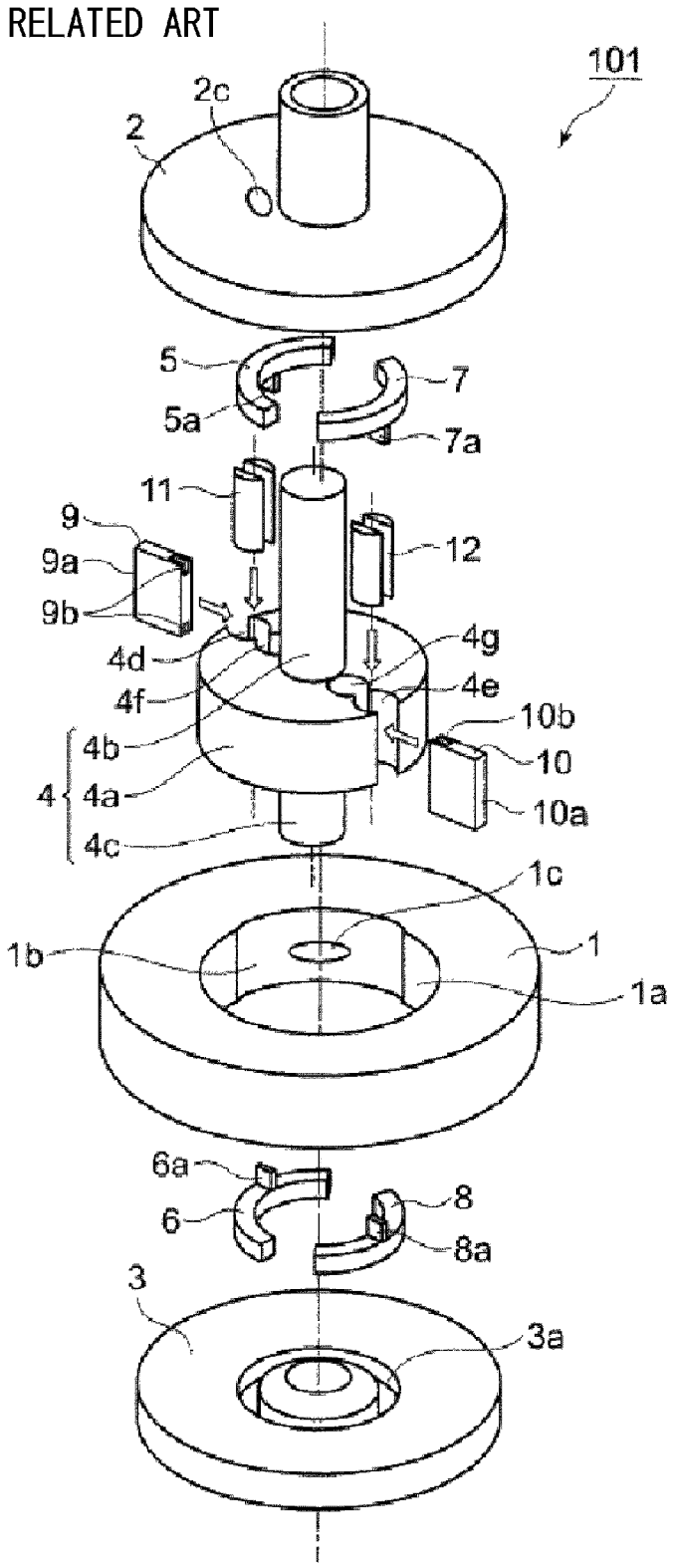
FIG. 2 is an exploded perspective view illustrating a compression element of the vane-type compressor of FIG. 1.
Figure 3:
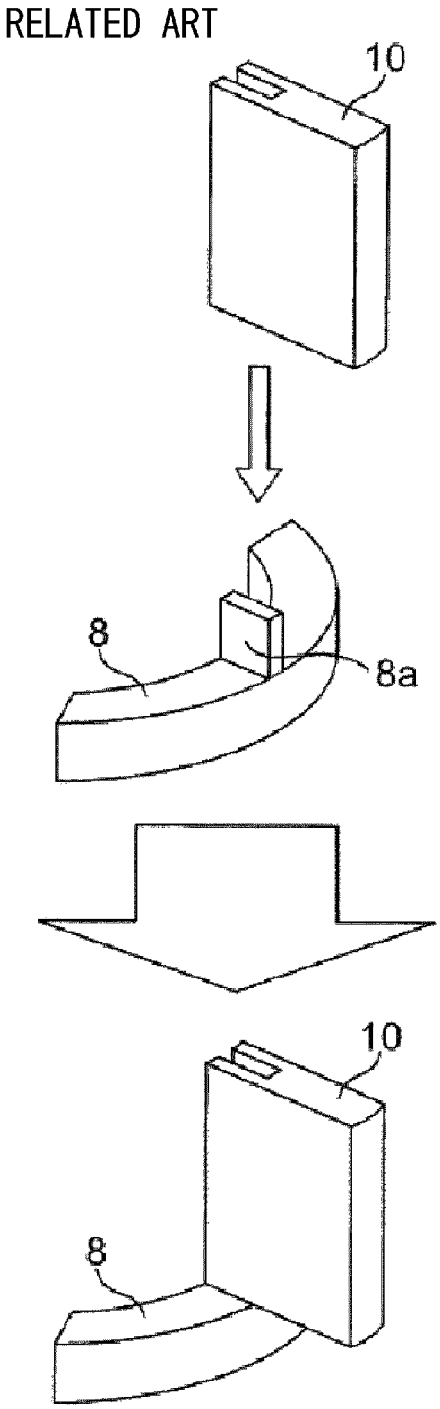
FIG. 3 is a perspective view illustrating a second vane and a vane aligner of the vane-type compressor of FIG. 1.
Figure 4:
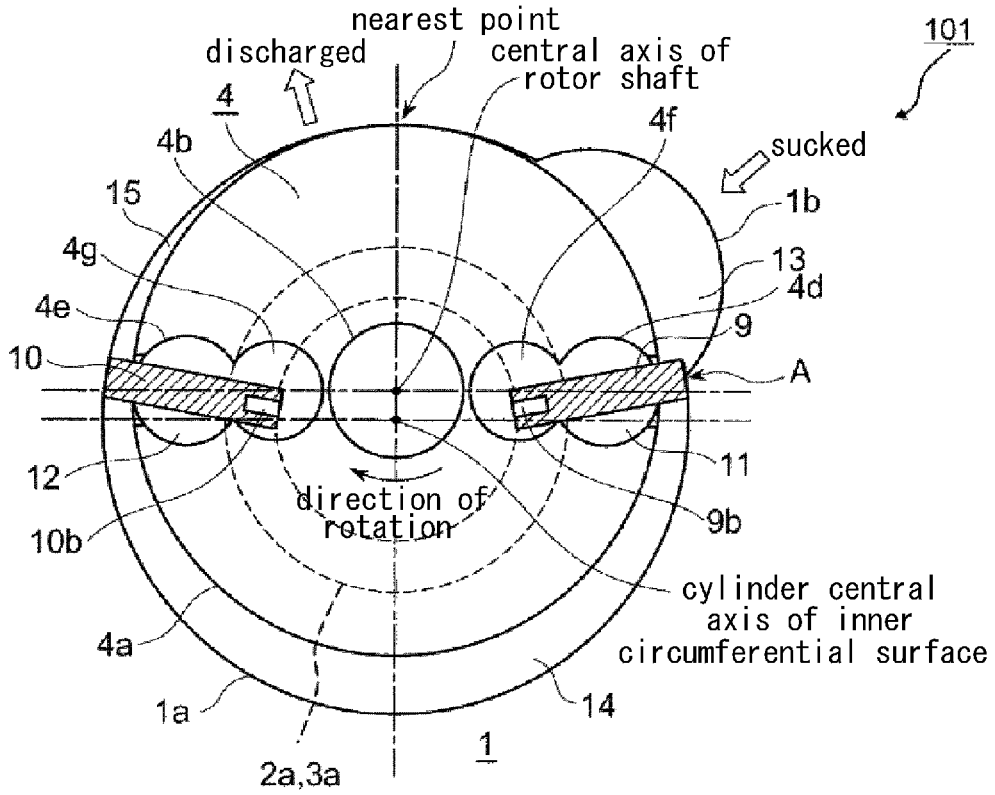
FIG. 4 RELATED ART
FIG. 4 is a plan view (rotational angle 90°) illustrating a compression element of the vane-type compressor of FIG. 1.
Figure 5:
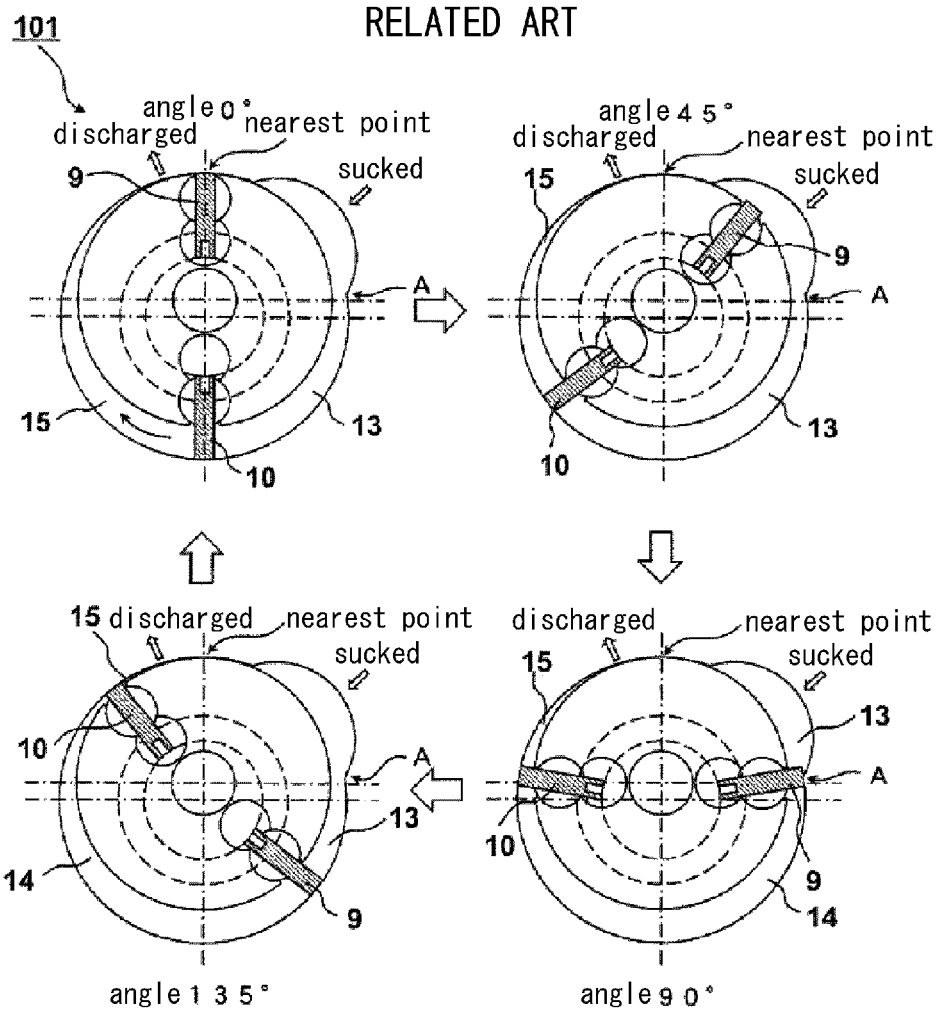
FIG. 5 is a plan view illustrating a compression element showing a compression operation of the vane-type compressor as shown in FIG. 1.

Hereinafter, embodiments are described hereinafter with reference to the accompanying drawings. The same or similar reference numerals may be used to denote the same or similar elements throughout the drawings and the specification, and repetitive description has been omitted.

It will be understood that when an element or layer is referred to as being "on," "connected to," "coupled to," or "adjacent to" another element or layer, it can be directly on, connected, coupled, or adjacent to the other element or layer, or intervening elements or layers may be present.

When determined to make the subject matter unclear, description of known art or functions may be skipped.

The accompanying drawings are provided merely for a better understanding of embodiments and the technical spirit or the scope are not limited by the drawings.

As used herein, the term "disclosure" may be replaced with other terms, such as "disclosure," "document," "specification," or "description."

Hereinafter, embodiments are described with reference to FIGS. 6 to 10.

Figure 6:
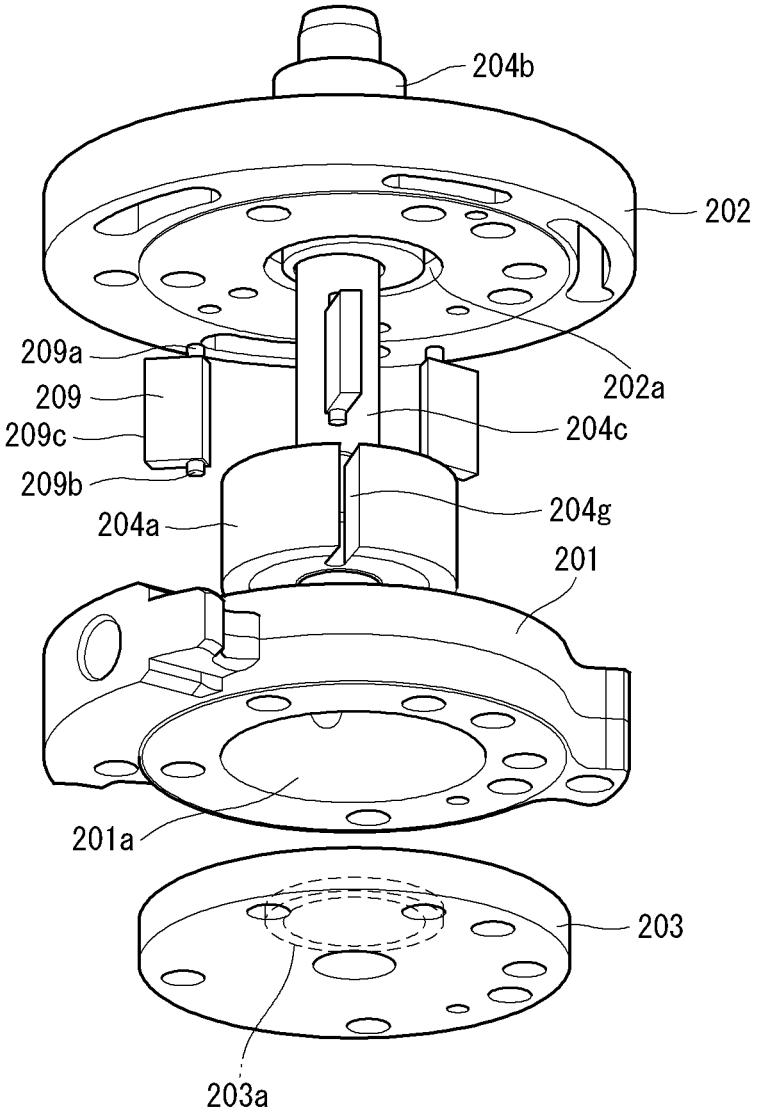
FIG. 6 is an exploded perspective view illustrating a compression element according to an embodiment.
Figure 7:
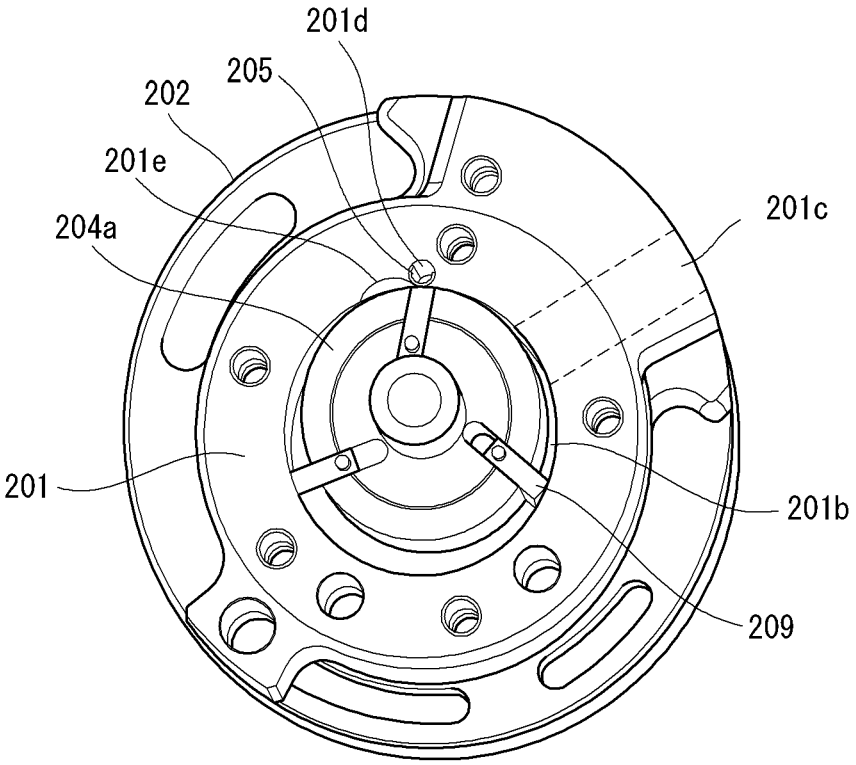
FIG. 7 is a plan view illustrating an assembled state of a rotor part, vane, and cylinder among compression elements as shown in FIG. 6.
Figure 8:
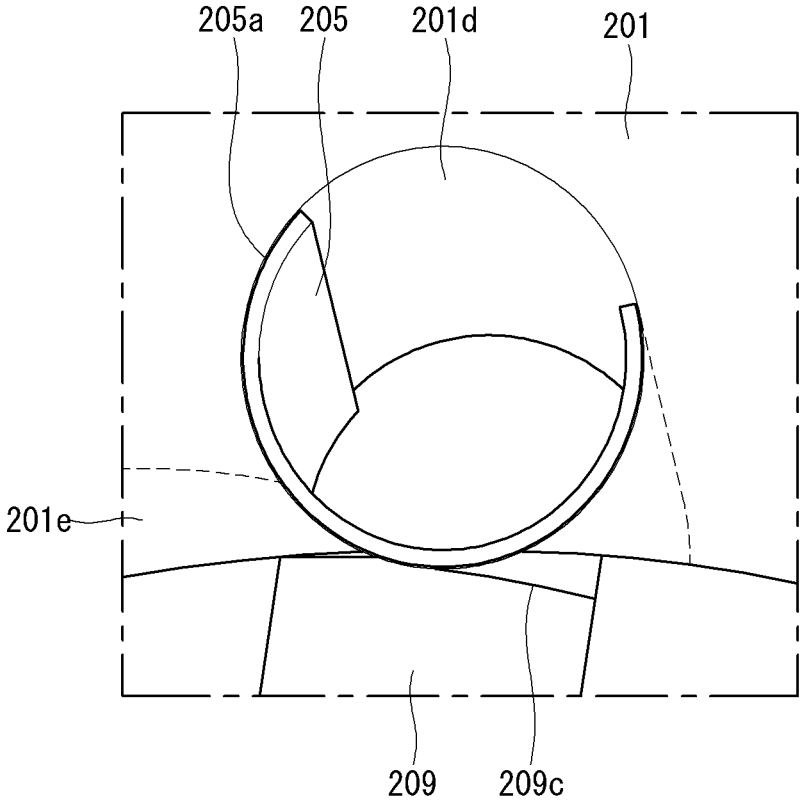
FIG. 8 is an enlarged view illustrating a main part of FIG. 7.
Figure 9:
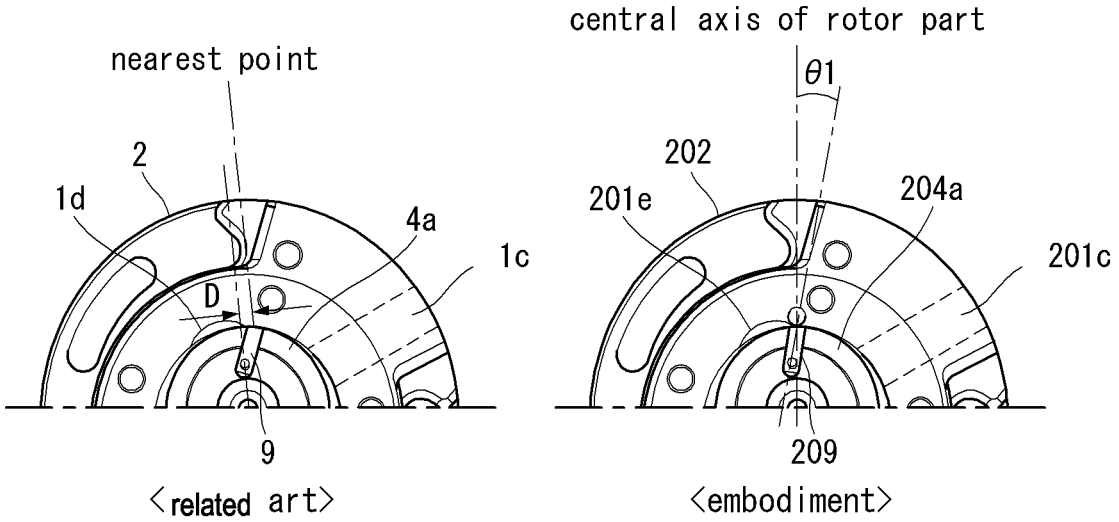
FIG. 9 is a view illustrating a comparison between a discharge dimple angle according to the related art and a discharge dimple angle according to an embodiment.

FIG. 6 is an exploded perspective view illustrating a compression element according to an embodiment. FIG. 7 is a plan view illustrating an assembled state of a rotor part, vane, and cylinder among compression elements as shown in FIG. 6. FIG. 8 is an enlarged view illustrating a main part of FIG. 7. FIG. 9 is a view illustrating a comparison between a discharge dimple angle according to the related art and a discharge dimple angle according to an embodiment. Although a vane-type compressor is described below as an example, the technology is also applicable to common sealed rotary compressors.

According to an embodiment, the vane-type compressor may be applied to refrigerators, freezers, or air conditioners. For example, an air conditioner may include a vane-type compressor 100 to compress coolant according to an embodiment, a condenser, a decompressor, and an evaporator.

Moreover, the vane-type compressor according to an embodiment is applicable to refrigerators, freezers, or air conditioners and may include a compression element, an electromotive element or unit (drive motor) that drives the compression element, and a sealed container that receives the compression element and the electromotive element.

As the above-described sealed container and electromotive element according to the related art may be adopted as the sealed container and the electromotive element, the compression element alone is described hereinafter. According to an embodiment, the compression element of the vane-type compressor may include a cylinder 201, a main bearing 202, a sub bearing 203, a rotor shaft 204, a vane 209, and an elastic member 205, discussed hereinafter.

The cylinder 201 may be substantially cylindrical in shape and both ends thereof, in the axial direction, may be open. Cylinder inner circumferential surface 201*a* may be eccentric with respect to an outer circumferential surface of the cylinder 201. A suction dimple 201*b* may be formed in the cylinder inner circumferential surface 201*a* by cutting in circle (at cross sectional view) to be externally larger than the cylinder inner circumferential surface 201*a*. An open suction port 201*c* may be formed in the cylinder inner circumferential surface 201*a* or the suction dimple 201*b*.

At a point of the cylinder inner circumferential surface 201*a*, where a minimum gap is maintained between the cylinder inner circumferential surface 201*a* and rotor part or portion 204*a*, a spring insertion part or portion 201*d* which may be circular in shape and at least a portion of which may be open inward of the cylinder inner circumferential surface 201*a* may be formed, and in the cylinder inner circumferential surface 201*a*, a discharge dimple 201*e* formed by cutting in circle (at cross sectional view) to be externally larger than the cylinder inner circumferential surface 201*a* may be formed so that one end thereof extends up to the point. The cylinder inner circumferential surface 201*a* may be shaped as a circle or may be formed in other shapes.

The main bearing 202 may have a substantially "T"-shaped cross-section, and a portion thereof, which abuts the cylinder 201, may have a substantially circulate plate shape. One opening (an upper one in FIG. 6) of the cylinder 201 may be closed.

A circular rail groove 202*a* which may be eccentric from the main bearing 202 may be formed in the surface, on the side of the cylinder 201, of the main bearing 202. The rail groove 202*a* may be shaped as a circle or may be formed in other shapes. A middle portion of the main bearing 202 may be cylindrical in shape, and a rotational shaft part or portion 204*b* may be inserted therethrough.

The sub bearing 203 may have a substantially "T"-shaped cross-section, and a portion thereof, which abuts the cylinder 201, may have a substantially circulate plate shape. The other opening (a lower one in FIG. 6) of the cylinder 201 may be closed.

A circular rail groove 203*a* which may be eccentric from the sub bearing 203 may be formed in the surface, on the side of the cylinder 201, of the sub bearing 203. The rail groove 203*a* may be shaped as a circle or may be formed in other shapes. At least one of the rail groove 202*a* of the main bearing 202 or the rail groove 203*a* of the sub bearing 203 may be formed in a shape other than a circle. A middle portion of the sub bearing 203 may be cylindrical in shape, and a rotational shaft part or portion 204*c* may be inserted therethrough.

The rotor shaft 204 may have a structure in which the rotor part 204*a*, which rotates on a central axis eccentric with respect to a central axis of the cylinder 201, and upper and lower rotational shaft parts 204*b* and 204*c* of the rotor part 204*a* are integrally formed with each other. The rotation shaft parts 204*b* and 204*c* may be engaged with a bearing part or portion of the main bearing 202 and a bearing part or portion of the sub bearing 203, respectively.

The rotor part 204*a* may include a vane installation part or portion 204*g* which penetrates in an axial direction. The vane installation part 204*g* may have an inclination angle θ1 ranging from 5° to 20° from a radial direction which passes through a central axis of the rotor shaft 204. The rotor shaft 204, main bearing 202, and sub bearing 203 may be concentric to one another.

The vane 209 may be shaped substantially as a rectangular plate and have protrusions 209*a* and 209*b* at both ends (top and bottom of FIG. 6) in the axial direction. The protrusions 209*a* and 209*b* may be fitted to the rail grooves 202*a* and 203*a*.

A plurality of vanes 209 may include tips 209*c* which are concentric and smaller than a diameter of the cylinder inner circumferential surface 201*a* of the cylinder 201 at a specific or predetermined angle between 40° and 160° in a rotational direction from a point at which suction is completed.

Each vane 209 may be coupled to the vane installation part 204*g* formed in the rotor part 204*a* and thus rotated along with the rotor part 204*a*. When the rotor part 204*a* is rotated, the vanes 209 partition the cylinder inner circumferential surface 201*a* of the cylinder 201 into a plurality of spaces including a suction chamber and a compression chamber.

Although FIG. 6 illustrates an example in which vanes are provided, the number of the vanes is not limited thereto as long as two or more vanes are provided.

The elastic member 205 may be formed as a circular or leaf spring and may be installed in spring insertion part or portion 201*d* formed at a point at which a minimum gap is maintained between the cylinder inner circumferential surface 201*a* and the rotor part 204*a*. A portion of the elastic member 205 may protrude inward of the inner circumferential surface 201*a* of the cylinder 201.

A coating layer 205*a* for lubrication may be formed on a surface of the circular or leaf spring. A back pressure may form at a back end of the circular or leaf spring inserted to the spring insertion part 201*d*.

When the spring insertion part 201*d* is overall formed in a circular shape, and the circular or leaf spring is installed in the spring insertion part 201, as shown in FIG. 8, a back pressure may be formed at the back end of the spring without using a separate structure. Thus, the circular or leaf spring may elastically contact the tip 209*c* of the vane 209, as shown in FIG. 8.

FIG. 6 shows a state before the vane 209 is integrated with the rotor part 204*a* and the bearings 202 and 203. In practice, the vane 209 is coupled to the vane installation part 204*g*, and the protrusions 209*a* and 209*b* of the vane 209 are fitted into the rail grooves 202*a* and 203*a*.

As the vane 209 is integrated with the rotor part 204*a* and the bearings 202 and 203, the number of components may be reduced as compared with the related art. Further, it is possible to effectively assemble the rotor part, vanes, and bearings (main bearing and sub bearing) and to reduce accumulated tolerances among components, thereby mitigating vibrational noise and reducing assembly and labor costs. It is also possible to make the vane-type compressor smaller and with more capacity by increasing an outer diameter or number of vanes.

The vane 209 and the rotor part 204*a* which have been integrated together, are rotated around the central axis of the cylinder inner circumferential surface 201*a*, and a distance between the central axis of the cylinder inner circumferential surface 201*a* and the vane tip 209*a* remains smaller than (or substantially identical to) a radius of the cylinder inner circumferential surface 201*a*.

Operations are described hereinafter. When the rotational shaft part 204*b* of the rotor shaft 204 receives a rotational force from a drive, for example, the electromotive element, or in the case of engine driving, an engine, the rotor part 204*a* rotates in the cylinder 201. As the rotor part 204*a* rotates, the vane 209 which is in the vane installation part 204*g* of the rotor part 204*a* is rotated along with the rotor part 204*a*.

A direction of the vane 209 is restricted to a direction of normal to the cylinder 201 by the protrusions 209*a* and 209*b* rotatably coupled to the rail grooves 202*a* and 203*a* formed, concentrically to the cylinder inner circumferential surface 201*a*, in the end surfaces, on the side of the cylinder, of the main bearing 202 and the sub bearing 203. Thus, the vane 209 is rotated around the central axis of the cylinder inner circumferential surface 201*a*, and the distance between the central axis of the cylinder inner circumferential surface 201*a* and the vane tip 209*a* remains smaller than (or substantially identical to) the radius of the cylinder inner circumferential surface 201*a*. Thus, the vane 209 is rotated as the protrusions 209*a* and 209*b* slide along the rail grooves 202*a* and 203*a*, with the vane tip 209*a* not in contact with the cylinder inner circumferential surface 201*a* of the cylinder 201.

As an arc of the vane tip 209*a* of the vane 209 and the cylinder inner circumferential surface 201*a* of the cylinder 201 have substantially a same radius, and their normal lines are substantially identical to each other, they rotate, with a fine gap formed therebetween. Thus, as the rotor part 204*a* of the rotor shaft 204 rotates, a volume of the suction chamber, intermediate chamber, and compression chamber in the cylinder 201 is varied so that coolant is suctioned and compressed.

In the compressor according to an embodiment, as the discharge dimple 201*e* is formed up to the elastic member 205 and the rotor part 204*a*, overcompression may be reduced during suction and compression, thereby achieving about 0.5% more mechanical efficiency. As the elastic member 205 comes in line contact with the rotor part 204*a*, discharge-suction leakage may be reduced during suction and compression, thus increasing volume and indication efficiency by about 3%.

Some of the above-described embodiments are interpreted as excluding or distinguishing from other embodiments. The components or functions in some embodiments described above may be used together or combined with components or functions in other embodiments.

For example, component A described in connection with a particular embodiment and the drawings may be combined or merged with component B described in connection with another embodiment and the drawings. In other words, a combination of components, although not explicitly described, may be rendered possible unless stated as impossible.

According to embodiments disclosed herein a vane-type compressor with improved efficiency and reduced noise by reducing overcompression and suction-discharge leakage is provided. According to embodiments disclosed herein, there is further provided a vane-type compressor with a reduced number of components, and by which assembly and labor costs may be decreased. According to embodiments disclosed herein, there is also provided a vane-type compressor which may be made more compact and with high capacity by increasing the outer diameter or the number of vanes.

According to embodiments disclosed herein, a vane-type compressor includes a cylindrical cylinder having two opposite open ends along an axial direction, an inner circumferential surface of the cylinder eccentric from an outer circumferential surface of the cylinder, a main bearing positioned at one open end of the two opposite open ends of the cylinder and a sub bearing positioned at the other open end of the two opposite open ends of the cylinder, a rotor part or portion coupled to a rotor shaft supported by the main bearing and the sub bearing and installed eccentric from the inner circumferential surface of the cylinder, and a plurality of vanes coupled to the rotor part to rotate along with the rotor part, the plurality of vanes dividing the inner circumferential surface of the cylinder into a plurality of spaces including a suction chamber and a compression chamber when the rotor part rotates. An elastic member may be installed at a point where a minimum gap is maintained between the inner circumferential surface of the cylinder and the rotor part so that a portion of the elastic member may protrude inward of the inner circumferential surface of the cylinder. An end of a discharge dimple formed in the inner circumferential surface of the cylinder may extend up to the point. By the configuration of the compressor, as the discharge dimple may extend up to the point where the minimum gap is maintained between the inner circumferential surface of the cylinder and the rotor part, overcompression and discharge-suction leakage may be reduced.

The elastic member may be formed as a circular or leaf spring. A coating layer for lubrication may be formed on a surface of the circular or leaf spring. Thus, frictional force may be reduced when a tip of the vane contacts the circular or leaf spring.

The cylinder may include a circular spring insertion part or portion to which the circular or leaf spring may be inserted. At least a portion of the spring insertion part may be open to an inside of the inner circumferential surface of the cylinder. Thus, a portion of the circular or leaf spring may project inward of the inner circumferential surface of the cylinder through the open part.

A back pressure may be formed at a back end of the circular or leaf spring inserted to the spring insertion part. Thus, a protrusion of the circular or leaf spring may elastically contact the tip of the vane.

The rotor shaft, the main bearing, and the sub bearing may be positioned concentrically. The main bearing and the sub bearing each may have a circular rail groove in a surface facing the vane. The vane may include a protrusion inserted into the rail groove. Thus, it is possible to effectively assemble the rotor part, vanes, and bearings (main bearing and sub bearing) and to reduce accumulated tolerances to thereby mitigate vibrational noise.

The rail groove may be eccentric from the main bearing and the sub bearing. Thus, an internal space of the cylinder may be divided into a plurality of spaces including a compression chamber and a suction chamber by the plurality of vanes.

The rail groove and the inner circumferential surface of the cylinder may be formed in a circle in which case each of the plurality of vanes may include a tip which is concentric and is smaller than a diameter of the inner circumferential surface of the cylinder at a predetermined angle between 40° and 160° in a rotational direction from a point where suction is completed.

Each of the plurality of vanes may be coupled to the rotor part at an inclination angle ranging from 5° to 20° from a radial direction passing through a central axis of the rotor part. A suction dimple may be formed in the inner circumferential surface of the cylinder. The suction dimple may have a suction port. As the suction dimple is formed in the inner circumferential surface of the cylinder, more gas (coolant) may be suctioned into the suction chamber.

In contrast, at least one of the rail groove or the inner circumferential surface of the cylinder may not be formed in circle. Even in such a case, a suction dimple may be formed in the inner circumferential surface of the cylinder, and the suction dimple may have a suction port. As the suction dimple is formed in the inner circumferential surface of the cylinder, more gas (coolant) may be suctioned into the suction chamber.

According to embodiments disclosed herein, the vane-type compressor may have improved efficiency and reduced noise by reducing overcompression and suction-discharge leakage. Further, according to embodiments disclosed herein, the vane-type compressor may have a reduced number of components and may thus decrease assembly and labor costs.

It is also possible to make the vane-type compressor smaller and with more capacity by increasing the outer diameter or the number of vanes. Thus, the above description should be interpreted not as limiting in all aspects but as exemplary. The scope of the disclosure should be determined by reasonable interpretations of the appended claims and all equivalents of the disclosure belong to the scope of the disclosure.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A vane compressor, comprising:

a cylinder having open ends along an axial direction, an inner circumferential surface of the cylinder being eccentric from an outer circumferential surface of the cylinder;

a main bearing positioned at a first end of the cylinder and a sub bearing positioned at a second end of the cylinder;

a rotor coupled to a shaft supported by the main bearing and the sub bearing and installed eccentric from the inner circumferential surface of the cylinder; and a plurality of vanes coupled to the rotor to rotate along with the rotor, the plurality of vanes dividing the inner circumferential surface of the cylinder into a plurality of chambers including a suction chamber and a compression chamber when the rotor rotates, wherein an elastic member is installed at a point at which a minimum gap is maintained between the inner circumferential surface of the cylinder and the rotor so that a portion of the elastic member protrudes inward of the inner circumferential surface of the cylinder, and wherein an end of a discharge dimple formed in the inner circumferential surface of the cylinder extends up to the point.

2. The vane compressor of claim 1, wherein the elastic member is a circular or leaf spring.

3. The vane compressor of claim 2, wherein a coating layer for lubrication is formed on a surface of the circular or leaf spring.

4. The vane compressor of claim 2, wherein the cylinder includes a spring recess that is circular into which the circular or leaf spring is inserted, and wherein at least a portion of the spring recess is open to an inside of the inner circumferential surface of the cylinder.

5. The vane compressor of claim 4, wherein a back pressure is formed at a back end of the circular or leaf spring inserted to the spring insertion recess.

6. The vane compressor of claim 1, wherein the shaft, the main bearing, and the sub bearing are positioned concentrically.

7. The vane compressor of claim 6, wherein the main bearing and the sub bearing each have a rail groove that is circular in a surface facing the plurality of vanes, and wherein each vane of the plurality of vanes includes a protrusion inserted into each of the respective rail grooves.

8. The vane compressor of claim 7, wherein the rail grooves are eccentric in the main bearing and the sub bearing.

9. The vane compressor of claim 8, wherein the rail grooves and the inner circumferential surface of the cylinder are each shaped as a circle.

10. The vane compressor of claim 9, wherein each of the plurality of vanes includes a tip which is concentric and smaller than a diameter of the inner circumferential surface of the cylinder at a predetermined angle between 40° and 160° in a rotational direction from a point at which suction is completed.

11. The vane compressor of claim 10, wherein each of the plurality of vanes is coupled to the rotor at an inclination angle ranging from 5° to 20° from a radial direction passing through a central axis of the rotor.

12. The vane compressor of claim 11, wherein a suction dimple is formed in the inner circumferential surface of the cylinder.

13. The vane compressor of claim 12, wherein the suction dimple includes a suction port.

14. The vane compressor of claim 8, wherein at least one of the rail grooves or the inner circumferential surface of the cylinder is not circular in shape.

15. The vane compressor of claim 14, wherein a suction dimple is formed in the inner circumferential surface of the cylinder.

16. The vane compressor of claim 15, wherein the suction dimple includes a suction port.

17. A vane compressor, comprising:

a cylinder having open ends along an axial direction, an inner circumferential surface of the cylinder being eccentric from an outer circumferential surface of the cylinder;

a main bearing positioned at a first end of the cylinder and a sub bearing positioned at a second end of the cylinder;

a rotor coupled to a shaft supported by the main bearing and the sub bearing and installed eccentric from the inner circumferential surface of the cylinder; and a plurality of vanes coupled to the rotor to rotate along with the rotor, the plurality of vanes dividing the inner circumferential surface of the cylinder into a plurality of chambers including a suction chamber and a compression chamber when the rotor rotates;

a recess formed in the cylinder; and a spring installed in the recess at a point at which a minimum gap is maintained between the inner circumferential surface of the cylinder and the rotor, wherein at least a portion of the recess is open to an inside of the inner circumferential surface of the cylinder such that a portion of the spring protrudes inward of the inner circumferential surface of the cylinder.

18. The vane compressor of claim 17, wherein the spring is a circular or leaf spring.

19. The vane compressor of claim 18, wherein a coating layer for lubrication is formed on a surface of the circular or leaf spring.

20. The vane compressor of claim 17, wherein an end of a discharge dimple formed in the inner circumferential surface of the cylinder extends up to the point.

21. The vane compressor of claim 17, wherein a back pressure is formed at a back end of the spring inserted into the recess.

* * * * *